United States Patent [19]

Frischer

[11] 3,961,217

[45] June 1, 1976

[54] GASEOUS DISCHARGE DISPLAY PANEL HAVING TWO COLOR BAR DISPLAY

[75] Inventor: Myles E. Frischer, Hillsborough, N.J.

[73] Assignee: Burroughs Corporation, Detroit, Mich.

[22] Filed: Feb. 24, 1975

[21] Appl. No.: 552,450

[52] U.S. Cl. ..... 313/188; 313/1; 313/217; 313/220; 315/169 TV

[51] Int. Cl.[2] ..... H01J 61/067; H01J 61/30; H01J 61/40

[58] Field of Search ..... 313/220, 188, 217, 1; 315/169 TV, 55

[56] References Cited

UNITED STATES PATENTS

| | | | |
|---|---|---|---|
| 3,202,868 | 8/1965 | Blank | 315/55 |
| 3,725,731 | 4/1973 | Kazan | 313/220 X |
| 3,792,301 | 2/1974 | Kessler | 313/220 X |
| 3,806,760 | 4/1974 | Shimada | 315/169 TV |

*Primary Examiner*—Palmer C. Demeo
*Attorney, Agent, or Firm*—Kevin R. Peterson; Robert A. Green; William B. Penn

[57] ABSTRACT

The display panel comprises a gas-filled envelope containing an array of line-like glow cathodes. Circuit means is coupled to the panel to scan the array of cathodes and to energize a number of cathodes determined by the magnitude of an input analog signal. The cathodes which are energized at any instant, display a bar of light. A light source is provided behind the panel to transmit light through the panel and between the line-like cathodes so that a viewer sees both a bar of cathode glow light, the length of which is determined by the analog signal, and a bar of light generated by the light source, the length of which is determined by the number of cathodes which are not energized and do not generate cathode glow.

19 Claims, 5 Drawing Figures

GASEOUS DISCHARGE DISPLAY PANEL HAVING TWO COLOR BAR DISPLAY

BACKGROUND OF THE INVENTION

The principles of the invention relate to bar graphs, an electronic glow cathode version of which has recently been developed by Burroughs Corporation and is described and claimed in copending application Ser. No. 542,130, filed Jan. 17, 1975. Although this device operates satisfactorily, it provides a bar of light in one color, and it is desirable to provide at least a two-color bar in response to input signals.

SUMMARY OF THE INVENTION

The display panel of the invention comprises an envelope which contains first light-emitting means adapted to emit light of one color, and second light-emitting means associated therewith for generating light of a second color. The first and second means together can generate a bar of light of predetermined length, the bar being made up of a portion of the one color, determined by the energization of the first means, and a second portion of the second color which makes up the remainder of the predetermined length.

DESCRIPTION OF THE PREFERRED EMBODIMENTS

Figure 1:
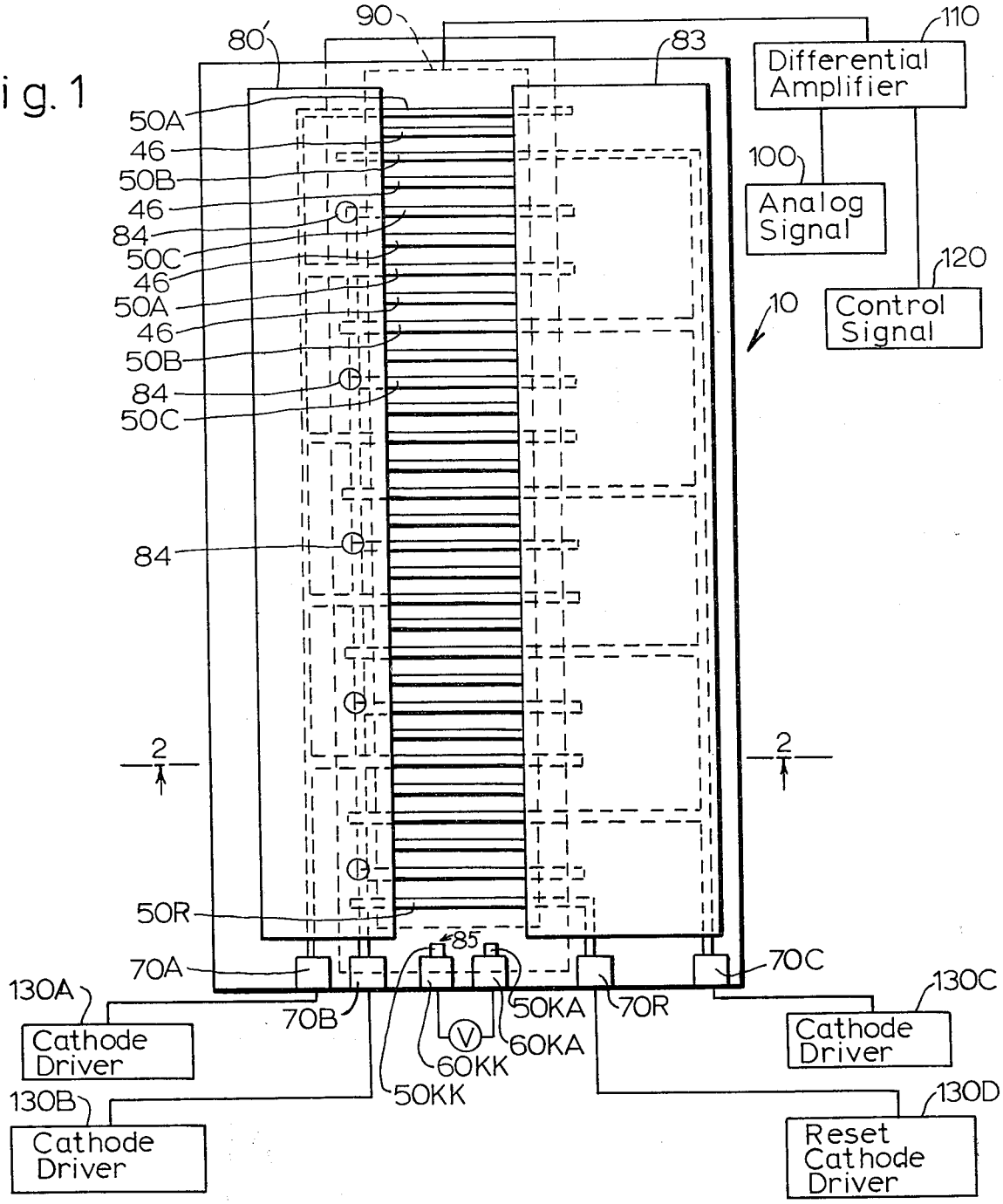
FIG. 1 is a plan view of a display panel embodying the invention.

A display panel 10 embodying the invention includes a transparent or translucent insulating base plate 20 of glass, or the like, and a glass face plate 30, which comprises a viewing window for the panel. The base plate and face plate are hermetically sealed together along their adjacent edges by means of a glass frit seal (not shown).

The base plate 20 includes a top surface 42, on which is formed a light-absorbing, preferably black, insulating layer 44 which serves to optimize the viewing contrast of the panel. The opaque layer is formed with generally rectangular openings 46 which are parallel to each other and are disposed spaced apart along, and perpendicular to, the axis of the base plate.

A series of closely spaced, parallel, line-like electrodes 50 are formed on the layer 44, preferably by a screen printing process. The electrodes 50 are disposed along, and perpendicular to, the axis of the base plate, alternating with the openings 46 in the layer 44. The electrodes 50 are disposed suitably close together so that, when they are operated as glow cathodes, the glow of one cathode will generally appear to merge with the glow of an adjacent cathode. Typically, the cathode lines have a width of about 10 to 12 mils, and they are spaced apart about 5 to 8 mils.

To achieve operating circuit economies as described in application Ser. No. 542,130, the conductive cathode lines 50 are electrically connected in groups, in this case three groups, cathodes 50A being in one group and cathodes 50B and 50C being in the other groups. As shown, the cathode lines alternate along the series in A, B, C order. The series of cathodes 50 define the maximum length of the bar of light which is generated if all of the cathodes glow.

Figure 2:
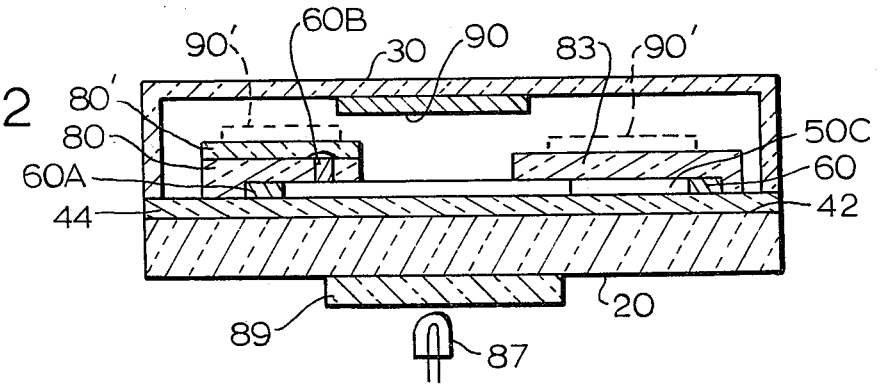
FIG. 2 is a sectional view along the lines 2—2 in FIG. 1.
Figure 3:
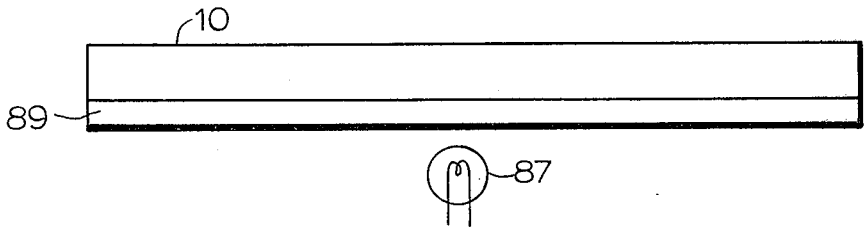
FIG. 3 is a side elevational view of the invention.

All of the cathodes 50A are connected to a conductor 60A which extends to the lower edge 24 of the base plate where it terminates in a contact pad 70A. Similarly, cathodes 50C are connected to a conductor 60C which terminates in a terminal pad 70C at the edge of the base plate. An insulating layer 80 is formed over conductor 60A, with apertures 84 overlying each of the cathodes 50B, and a conductor 60B is formed in the insulating layer 80 in contact with each cathode 60B and terminating in contact pad 70B. Insulation 80' (FIG. 2) covers conductor 60B.

A similar insulating layer 83 is formed over the conductor 60C and portions of the cathodes 50C. In addition, the layers 80 and 83 are spaced apart a suitable distance to provide a desired viewable length for the cathodes 50 between them.

As described in application Ser. No. 542,130, the panel includes an auxiliary "reset" cathode 50R positioned adjacent to the first cathode 50A in the series, and connected to contact pad 70R, and a keep-alive cell 85 comprising a small-area anode 50KA and a small-area cathode 50KK disposed adjacent to the reset cathode 50R and connected to contact pads 60KK and 60KA.

The face plate of the panel includes, on its lower surface, a transparent conductive film anode 90 of tin oxide or the like which comprises a rectangular strip which extends from the upper edge to the lower edge of the panel and overlies the exposed cathodes 50. The anode is also in operative relation with cathode 50R.

If desired, suitable masks are provided to shield the keep-alive cell 85 and reset cathode 50R from view.

In panel 10, the base plate and face plate are spaced apart a distance of the order of 20 to 25 mils, and the gas in the panel is provided at a pressure of the order of 400 Torr. One suitable gas mixture comprises 99.8% neon and 0.2% xenon. Another suitable gas filling is pure neon. With this arrangement of gas pressure and close spacing of base plate and face plate, as each cathode line 50 and the anode 90 are energized, cathode glow can be limited to the close vicinity of a single energized cathode even though the cathodes are connected in groups, and, as glow is transferred from cathode to cathode, no spurious glow develops at undesired locations. This is because the ionized particles, including metastable states, are limited in their ability to diffuse and are neutralized by the closely spaced base plate and face plate.

Figure 4:
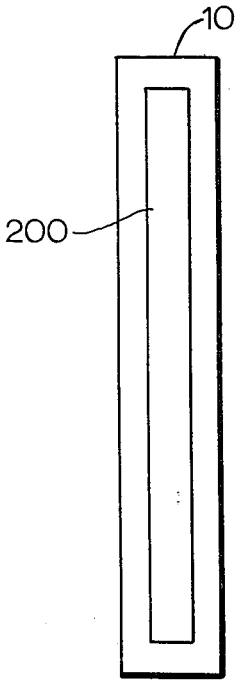
FIG. 4 is a schematic representation of a display panel embodying the invention as it appears in one mode of operation.

According to the invention, a source of light of any suitable type, for example, an incandescent bulb 87, is mounted behind the panel base plate and behind a suitable diffusing element 89 so that it can shine light through all of the apertures 46. The base plate itself may be a diffusing element. Either the light source is of a particular color, for example green, or a suitable filter is coupled to the light source, for example in the diffuser, to provide the desired color of light. With the light source in place and emitting light, assumed to be green light for purposes of this description, a bar of green light is visible to a viewer, the bar being made up of green light passing through all of the apertures 46 in the layer 44, as represented schematically in FIG. 4.

Figure 5:
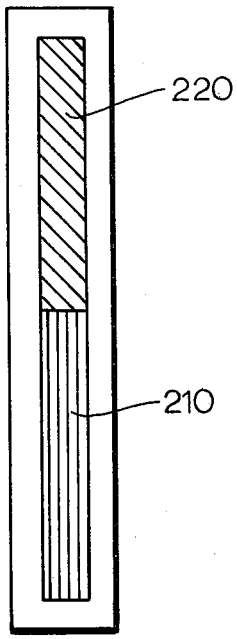
FIG. 5 shows the panel of FIG. 4 as it appears in another mode of operation.

The cathodes 50 generate generally orange glow in neon or a neon-containing gas, and, if the cathodes are operated in a manner described in copending application Ser. No. 542,130, filed Jan. 17, 1975 to generate a bar of light 210 (FIG. 5) representative of an input electrical signal, then this bar of cathode glow light will mask the green light coming through the openings 46 which are co-extensive with the length of the bar of orange light. And as illustrated schematically in FIG. 5, a viewer will see a bar 210 of orange light extending from the bottom of the panel and having a length determined by the amplitude of the applied signal, and the remainder of the panel comprises a bar 220 of green light extending from the upper end of the orange bar 210 to the upper end of the panel.

One suitable circuit for operating panel 10 shown in Ser. No. 542,130 is shown schematically in FIG. 1 and includes a source of analog signals, to be displayed, coupled into a differential amplifier 110 along with a ramp voltage from source 120. A separate cathode driver 130A, 130B, 130C, is connected to each of the groups of cathodes 50. In addition, a reset cathode driver 130R is connected to the reset cathode 50R, and voltage source V is connected to the keep-alive cell 85. In operation of panel 10, as thus connected, the keep-alive cell provides a constant source of excited particles, and, at the beginning of a scanning cycle, reset cathode driver 130R is operated to cause reset cathode 50R to glow and generate excited particles, and then operating potential is applied by the other cathode drivers 130 sequentially to each of the other cathodes 50 in turn, beginning with cathode 50A adjacent to the reset cathode 50R. Simultaneously, operating potential is applied to the anode 90 from the output of the differential amplifier.

As long as there is an output from the differential amplifier, energization of the cathode lines extends from the beginning of the series along the series until the analog signal and the ramp signal are equal. At this time, there is no output from the differential amplifier, and the anode is de-energized; however, the series of cathode drivers is operated until the end of the series of cathodes is reached to insure uniform duty cycle each time cathodes are energized. During this time period, the cathodes glow up to a line in the cathode series determined by the magnitude of the analog signal and the length of time during which the anode is energized. Thus, a bar of cathode glow light is seen extending along a length of the cathode lines representative of the amplitude of the analog signal. This operation is repeated cyclically at such a rate that a stationary but changeable length of light appears to glow in the panel.

Other circuits and modes of operation may be used to operate the panel 10. In addition, it is clear that modifications may be made in the specific structural features described above. For example, the anode electrode may be formed on the face plate, or it may be formed on one of the insulating layers carried by the base plate. In addition, the line-like cathodes could be disposed in a circular array or in any other array.

What is claimed is:

1. A display panel comprising an envelope having a viewing window, first light-emitting means in said envelope adapted to emit light of one color, and second light-emitting means associated with said first means for generating light of a second color, said first and second means together being able to generate a bar of light of predetermined length, the bar being made up of a first portion having said one color, determined by the energization of said first means, and a second portion of the second color, said first portion of said one color and said portion of said second color together having said predetermined length.

2. The panel defined in claim 1 wherein said second light-emitting means comprises a source of light disposed outside said panel and adapted to transmit light into said panel.

3. The panel defined in claim 1 wherein said envelope includes a base plate and a face plate viewing window, and said second light-emitting means comprises a source of light disposed outside said panel adjacent to said base plate.

4. The panel defined in claim 1 wherein said first light-emitting means comprises a first array of line-like light-emitting members and said second light-emitting means comprises a second array of line-like light-emitting members, said first and second arrays being substantially co-extensive with each other.

5. A display panel comprising an envelope having a viewing window, first light-emitting means disposed along a path in said envelope and adapted to emit light of one color, and second light-emitting means disposed along said path and associated with said first means and adapted to generate light of a second color, said first and second means together being able to generate a bar of light of predetermined length, the bar being made up of a first portion having said one color, determined by the energization of said first means, and a second portion of the second color, said first portion of said one color and said second portion of said second color together having said predetermined length.

6. A display panel comprising a gas-filled envelope having a viewing window, first glow cathode light-emitting means in said envelope adapted to emit light of one color, and second light-emitting means associated with said first means for generating light of a second color, said first and second means together being able to generate a bar of light of predetermined length, the bar being made up of a first portion having said one color, determined by the energization of said first means, and a second portion of the second color, said first portion of said one color and said second portion of said second color together having said predetermined length.

7. The panel defined in claim 6 wherein said first light-emitting means comprises a first array of line-like glow cathode members, and said second light-emitting means comprises a second array of line-like light-emitting members, said first and second arrays being substantially coplanar with each other.

8. The panel defined in claim 6 wherein said first light-emitting means comprises a first array of line-like glow cathode members, and said second light-emitting means comprises a second array of line-like light-emitting members, said first and second arrays being substantially coplanar with each other, with the members of the first array alternating with the members of the second array.

9. The panel defined in claim 6 wherein said second light-emitting means comprises a source of light disposed outside said panel and adapted to transmit light into said panel.

10. The panel defined in claim 6 wherein said envelope includes a base plate and a face plate viewing window, and said second light-emitting means comprises a source of light disposed outside said panel adjacent to said base plate.

11. A flat panel for displaying bars of light comprising a gas-filled envelope including a base plate and a viewing face plate hermetically sealed together, a plurality of thin, parallel, linear cathodes disposed in a series along the surface of said base plate, with a narrow space between adjacent cathodes, and including means whereby each cathode can be separately electrically energized in turn along said series, an energized cathode generating cathode glow of a first color, an anode electrode overlaying and in operative relation with said series of linear cathodes, means for electrically energizing said anode as said series of cathodes is energized, and means coupled to said panel lighting the spaces between said cathodes with light of a second color so that when cathodes are not glowing, a bar of light of such second color is visible to a viewer through said face plate.

12. The panel defined in claim 11 wherein said cathodes are connected in groups with a single common conductor connected to each such group.

13. The panel defined in claim 11 and including a linear reset cathode positioned adjacent to and ahead of the first cathode in said series for use in starting a scanning cycle for said series of cathodes.

14. The panel defined in claim 11 wherein said linear cathodes have a width of about 10 to 12 mils and they are spaced apart about 5 to 8 mils.

15. The panel defined in claim 11 wherein the spacing between the anode and the line of cathodes is about 10 to 25 mils and the gas in the panel is at a pressure of about 400 Torr.

16. A flat panel for displaying bars of light of different lengths comprising a gas-filled envelope including a base plate and a viewing face plate hermetically sealed together, said base plate having first and second opposite edges, a plurality of thin, parallel, linear cathodes disposed in a series along the surface of said base plate, with a transparent space between adjacent cathodes, said cathodes being adapted to produce cathode glow of one color when energized, an anode electrode overlaying and in operative relation with said series of linear cathodes, and means coupled to said panel lighting the spaces between said cathodes with light of a second color so that where cathodes are not glowing, a bar of light of such second color is visible to a viewer through said face plate.

17. A flat panel for displaying bars of light of different lengths comprising a gas-filled envelope including a base plate and a viewing face plate hermetically sealed together, said base plate having first and second opposite edges, a coating of opaque material on said base plate having an array of transparent apertures disposed along said base plate, a plurality of thin, parallel, line-like cathodes disposed in a series along the surface of said base plate interleaved with said transparent apertures, said cathodes being adapted to generate cathode glow of a characteristic color when energized, an anode electrode overlaying and in operative relation with said series of line-like cathodes, and means coupled to said panel lighting said apertures with light of a second color so that where cathodes are not glowing, a bar of light of such second color is visible to a viewer through said face plate.

18. The panel defined in claim 17 wherein said means comprises a source of light disposed outside said panel and adapted to transmit light into said panel.

19. The panel defined in claim 17 wherein said means comprises a source of light disposed outside said panel adjacent to said base plate.

* * * * *